US007744315B2

(12) United States Patent
Kim et al.

(10) Patent No.: US 7,744,315 B2
(45) Date of Patent: Jun. 29, 2010

(54) REINFORCEMENT OF FOUNDATION

(75) Inventors: Kwang-Man Kim, Seoul (KR); Sang-Mun Yun, Seoul (KR)

(73) Assignee: Baro Construction Key-Technology Co., Ltd., Seoul (KR)

( * ) Notice: Subject to any disclaimer, the term of this patent is extended or adjusted under 35 U.S.C. 154(b) by 624 days.

(21) Appl. No.: 10/597,731

(22) PCT Filed: Feb. 4, 2005

(86) PCT No.: PCT/KR2005/000333

§ 371 (c)(1),
(2), (4) Date: Jun. 1, 2007

(87) PCT Pub. No.: WO2005/075750

PCT Pub. Date: Aug. 18, 2005

(65) Prior Publication Data

US 2007/0294969 A1 Dec. 27, 2007

(30) Foreign Application Priority Data

Feb. 5, 2004 (KR) ..... 10-2004-0007692
Feb. 3, 2005 (KR) ..... 10-2005-0009947

(51) Int. Cl.
*E02D 27/08* (2006.01)

(52) U.S. Cl. ..... 405/229; 52/648.1; 52/649.1

(58) Field of Classification Search ..... 405/229, 405/282, 283; 52/223.7, 223.9, 292, 294, 52/334, 426, 648.1, 649.1, 650.1
See application file for complete search history.

(56) References Cited

U.S. PATENT DOCUMENTS

| | | | | |
|---|---|---|---|---|
| 5,366,323 | A * | 11/1994 | Nicholson | 405/119 |
| 6,050,038 | A * | 4/2000 | Fey et al. | 52/223.7 |
| 6,076,311 | A * | 6/2000 | Godfrey | 52/143 |
| 6,240,700 | B1 * | 6/2001 | Sheu | 52/741.13 |
| 6,349,520 | B2 * | 2/2002 | Kubica | 52/426 |
| 2002/0062615 | A1 * | 5/2002 | Gibson | 52/649.1 |
| 2004/0035073 | A1 * | 2/2004 | Bravinski | 52/426 |
| 2004/0226236 | A1 * | 11/2004 | Pidgeon | 52/236.2 |
| 2005/0025572 | A1 * | 2/2005 | Sanfilippo et al. | 405/36 |

* cited by examiner

*Primary Examiner*—Tara Mayo-Pinnock
(74) *Attorney, Agent, or Firm*—Fish & Richardson P.C.

(57) ABSTRACT

The present invention relates to a reinforcement of foundation which comprises at least two base steel plates arranged to be upright with respect to the ground and shaped as a plate with a cutaway formed at a top portion thereof, a reinforced steel plate coupled to upper portions of both ends of the base steel plates, fastening steel rods placed to extend in a longitudinal direction of the base steel plate and coupled to the reinforced steel plate, and a connection steel rod bored sequentially through the base steel plates and coupled to the base steel plates. According to the present invention, huge concentrated load exerted on a foundation can be uniformly distributed, and thus, load transmitted from a pillar or column installed on the foundation can be stably supported. Further, the thickness of foundation can also be reduced as compared with the prior art, and thus, the excavation can be made shallow. Accordingly, the period and expense of construction can be reduced.

9 Claims, 6 Drawing Sheets

[Fig. 2]
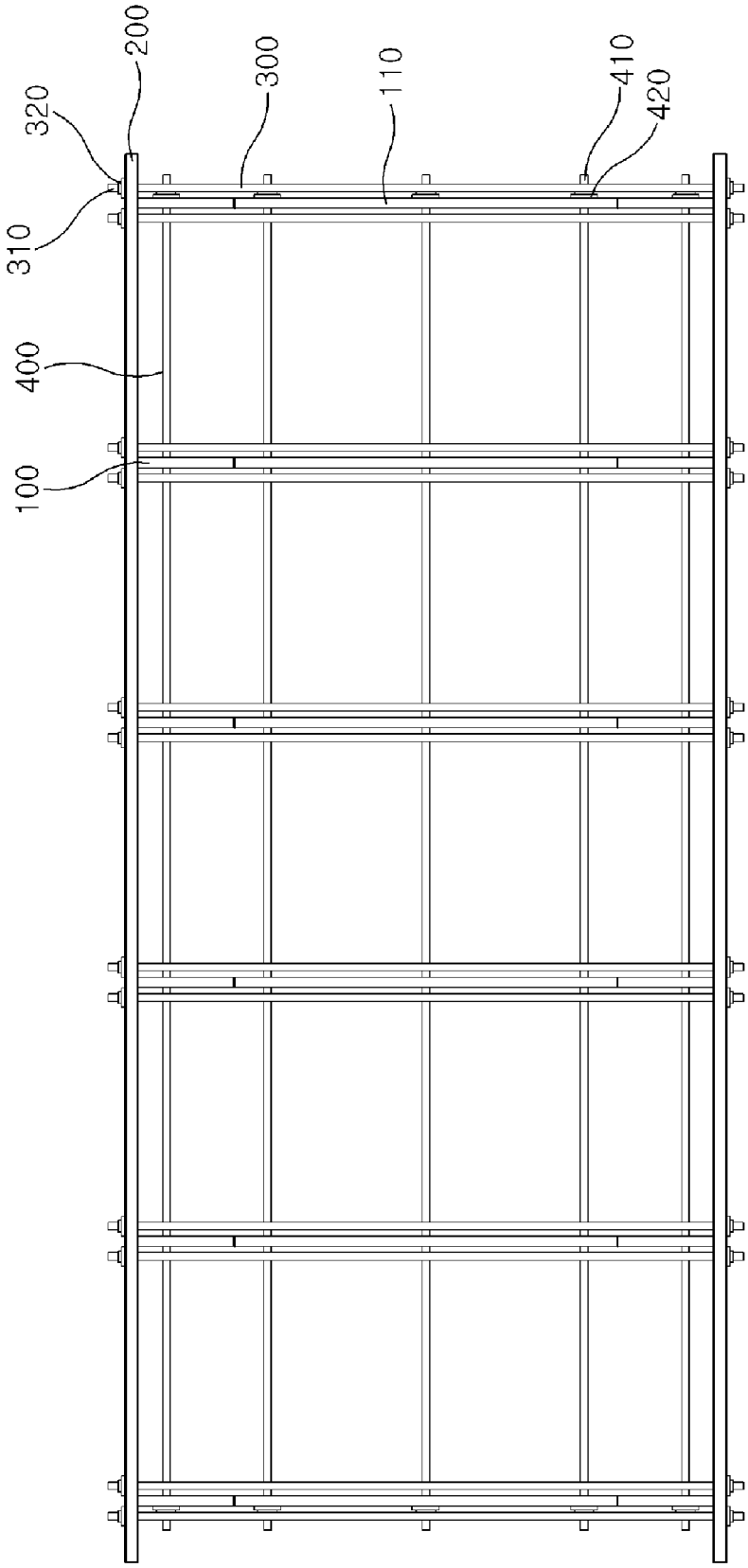

[Fig. 3]
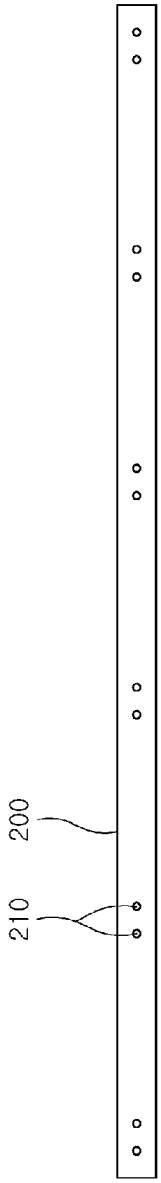
[Fig. 4]
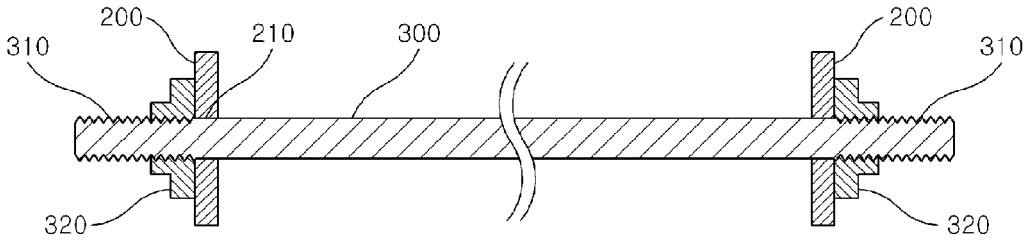

[Fig. 5]
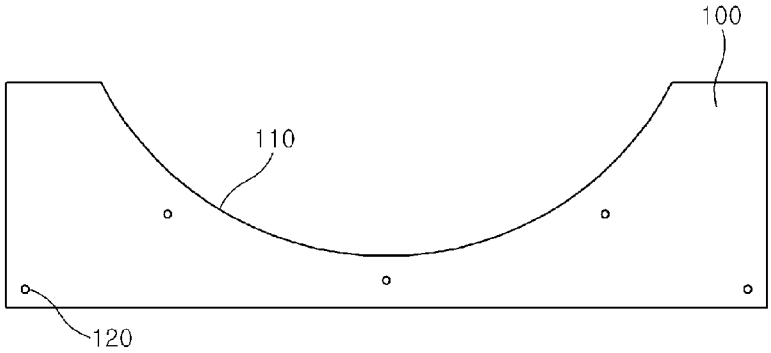
[Fig. 6]
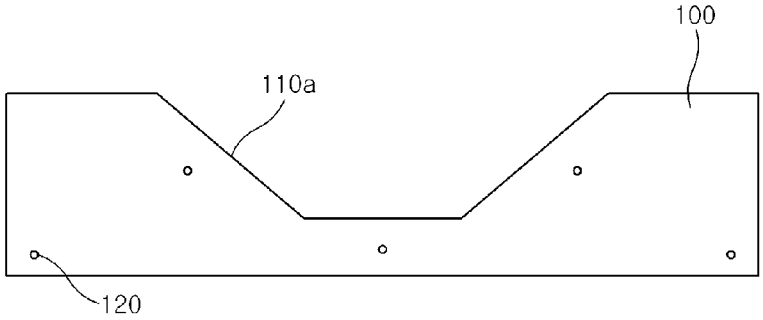
[Fig. 7]
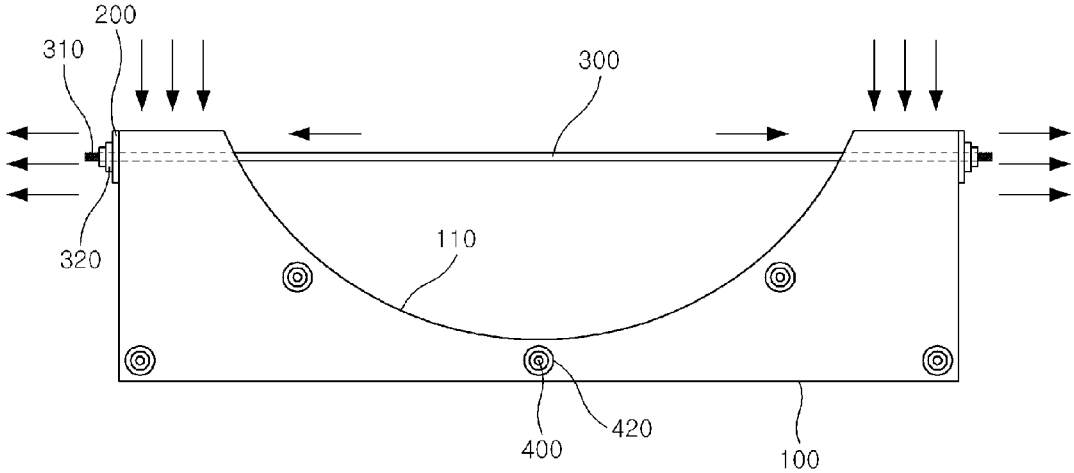

[Fig. 8]
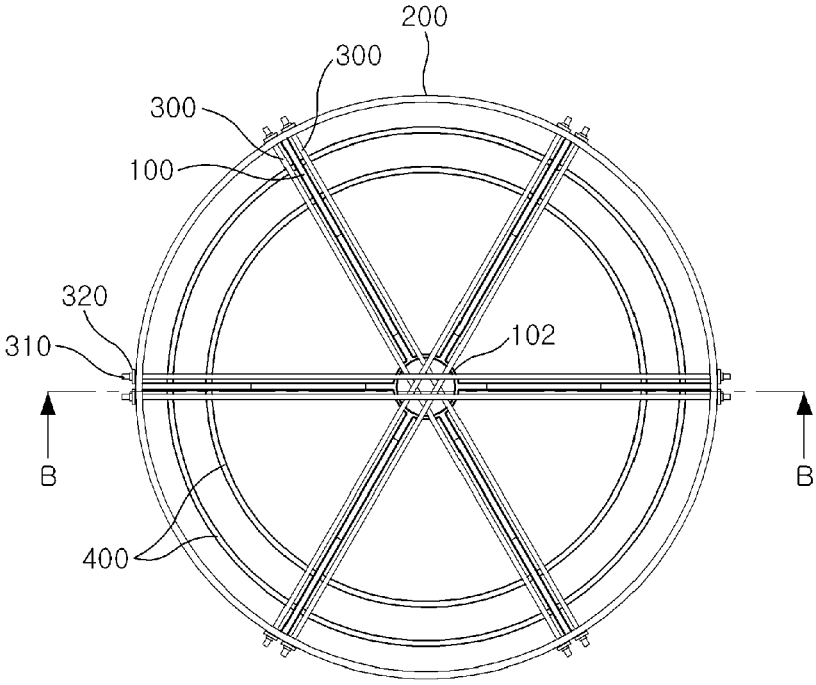
[Fig. 9]
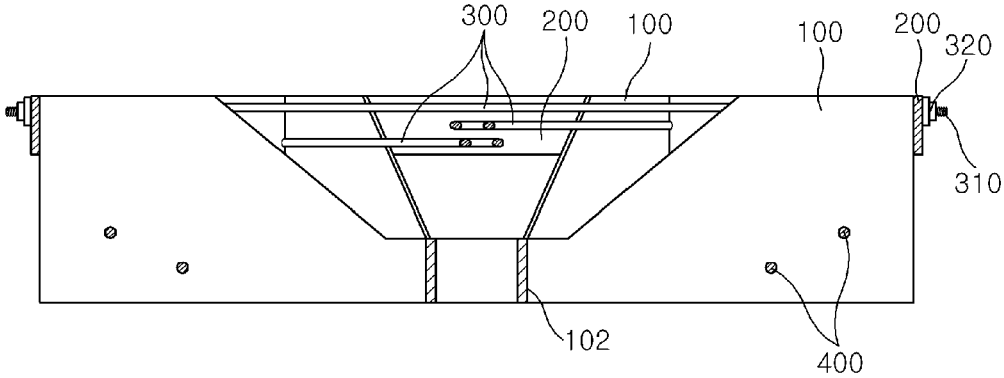

[Fig. 10]
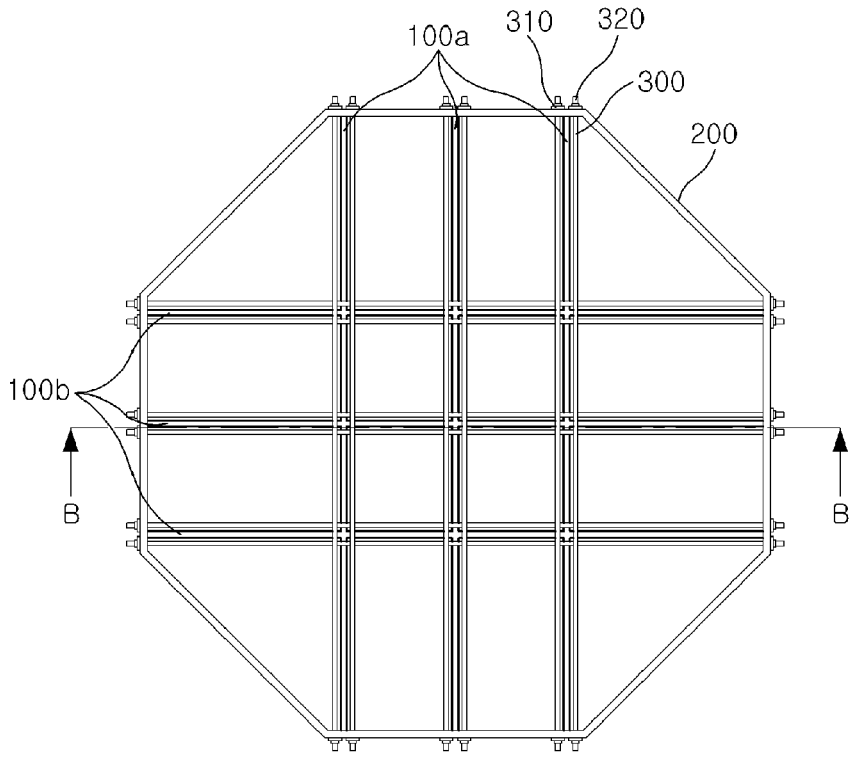
[Fig. 11]
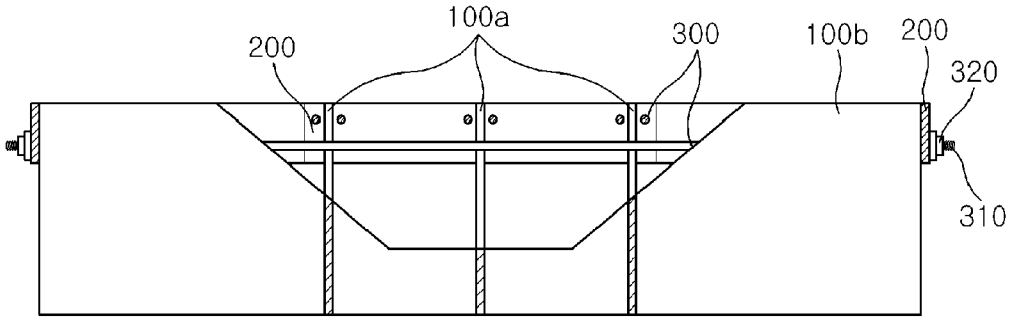

REINFORCEMENT OF FOUNDATION

TECHNICAL FIELD

The present invention relates to a foundation plate for supporting a bottom surface of a heavy object or building such that the object or building is stably placed on the ground. More specifically, the invention relates to a reinforcement of foundation constructed such that it can support a large load even due to its small volume.

BACKGROUND ART

In general, a foundation plate is constructed at a bottom portion of a building such that a load of the building can be uniformly distributed over the ground, upon the construction thereof, to prevent the ground from subsiding due to the building weight. In such a case, the conventional foundation plate has been designed to be constructed of thick reinforced concrete.

As the dimension of building has been recently increased, a load applied to a foundation plate is also being increased. In case of a conventional foundation plate, bending strength and shear strength have been increased in such a manner that the foundation plate constructed of general reinforced concrete is increased in size as a load to be applied to the foundation plate is increased.

As the size of the foundation plate is increased, therefore, an excavation depth should be increased enough to bury the foundation plate in the ground. Accordingly, there is a problem in that the construction period and expense are excessively consumed since the excavation work for burying the foundation plate and the manufacture work for manufacturing the foundation plate are increased in scale. In particular, in a case where a building should be constructed on a rock, the excavation work is very difficult. Thus, the construction period and expense are remarkably increased.

Further, in a case where the foundation plate is conventionally constructed of reinforced concrete, it is inevitably brought into contact with underground water as the excavation depth is increased. In such a case, if the foundation plate is in contact with underground water for a long time, there is another problem in that the reinforced concrete is deteriorated, whereby a load of building cannot be stably supported.

Furthermore, in a case where the excavation should be made deep, a desired land should be dug wider in an upward direction to prevent wall surfaces of the dug portion from collapsing and to secure as working space. If the excavation is made in such a way, it causes damage to neighboring buildings. Thus, there is a further problem in that the construction cannot be easily made at a place where the buildings stand close together. Moreover, if the excavation is made in such a manner that the desired land should be dug wider in an upward direction, a space where the concrete should be poured is increased. Therefore, there is a still further problem in that the concrete is wasted.

DISCLOSURE OF INVENTION

Technical Problem

The present invention is conceived to solve the aforementioned problems. Accordingly, an object of the present invention is to provide a reinforcement of foundation constructed in such a manner that external load is effectively distributed even though its foundation is not constructed to be larger and no deflection is produced therein even though the large load is applied thereto.

Technical Solution

According to an aspect of the present invention for achieving the above object, there is provided a reinforcement of foundation which comprises at least two base steel plates shaped as a plate and arranged to be upright with respect to the ground, a reinforced steel plate coupled to both ends of the base steel plates; and fastening steel rods coupled to the reinforced steel plate to be parallel with the base steel plates.

At this time, the base steel plates may be arranged in parallel with each other, be radially arranged to have a constant angular interval around a vertical centerline, or include at least two transversal base steel plates arranged in a transversal direction and at least one longitudinal base steel plate arranged in a longitudinal direction and coupled to the transversal base steel plates.

The reinforced steel plate may be independently coupled to top portions of both ends of the base steel plate in a case where the base steel plates are arranged in parallel with each other. Further, the reinforced steel plate may be coupled to the base steel plate to cover both ends of the base steel plate in a case where the base steel plates are arranged in radial shape or to overlap perpendicularly with each other.

Furthermore, in a case where the base steel plates are arranged in a radial shape, it is preferably configured such that a central pipe with a vertical central axis be provided at a portion where the respective base steel plates 100 join together and that the respective base steel plates are cut along the vertical central axis and their inner ends are then welded to an external surface of the central pipe.

The base steel plate may be provided with a cutaway at the center of the top portion thereof. At this time, the cutaway may have a bent shape or an arc shape.

Preferably, a pair of the fastening steel rods are placed to extend in a longitudinal direction of the base steel plates and coupled to the reinforced steel plate to be spaced apart rightward and leftward from positions where the base steel plates and reinforced steel plate are coupled to each other.

More preferably, the reinforced steel plate includes first through-holes formed at positions corresponding to both ends of each of the fastening steel rods, and each of the fastening steel rods is coupled to the reinforced steel plate such that the both ends of the fastening steel rod can pass through the first through-holes and protrude outward from the reinforced steel plate. Further, first male threads may be formed on the both ends of the fastening steel rod that protrude from the reinforced steel plate. At this time, the fastening steel rod is fastened to the reinforced steel plate by means of first nuts that can be engaged with the first male threads.

Further, the base steel plate may include at least one second through-hole bored therethrough in a direction in which the base steel plates are arranged, and the reinforcement of foundation may further comprise a connection steel rod which sequentially passes through the second through-holes of the base steel plates and is coupled to the base steel plates.

Furthermore, the connection steel rod may protrude outward from the base steel plates, and second male threads may be formed on the protruding ends of the connection steel rod. At this time, the connection steel rod may be fastened to the base steel plate by means of second nuts that can be engaged with the second male threads, in the same manner as the fastening steel rod.

BRIEF DESCRIPTION OF DRAWINGS

FIG. 2 is a plan view of the reinforcement of foundation according to the first embodiment of the present invention.

FIG. 3 is a front view of a reinforced steel plate of the reinforcement of foundation shown in FIGS. 1*a* and 2.

FIG. 4 is a sectional view of a fastening steel bar and its peripherals taken along line A-A of FIG. 1*a*.

FIG. 5 is a side view of the base steel plate of the reinforcement of foundation shown in FIGS. 1*a* and 2.

FIG. 6 is a side view of a base steel plate according to another embodiment of the present invention.

FIG. 7 is a side view schematically illustrating a direction of stress produced at respective portions due to a load applied to a reinforcement of foundation according to the present invention.

FIG. 8 is a plan view of a reinforcement of foundation according to a second embodiment of the present invention.

FIG. 9 is a sectional view of the reinforcement of foundation taken along line B-B of FIG. 8.

FIG. 10 is a plan view of a reinforcement of foundation according to a third embodiment of the present invention.

FIG. 11 is a sectional view of the reinforcement taken along line C-C of FIG. 10.

BEST MODE FOR CARRYING OUT THE INVENTION

Figures 1A, 1B, 1C:
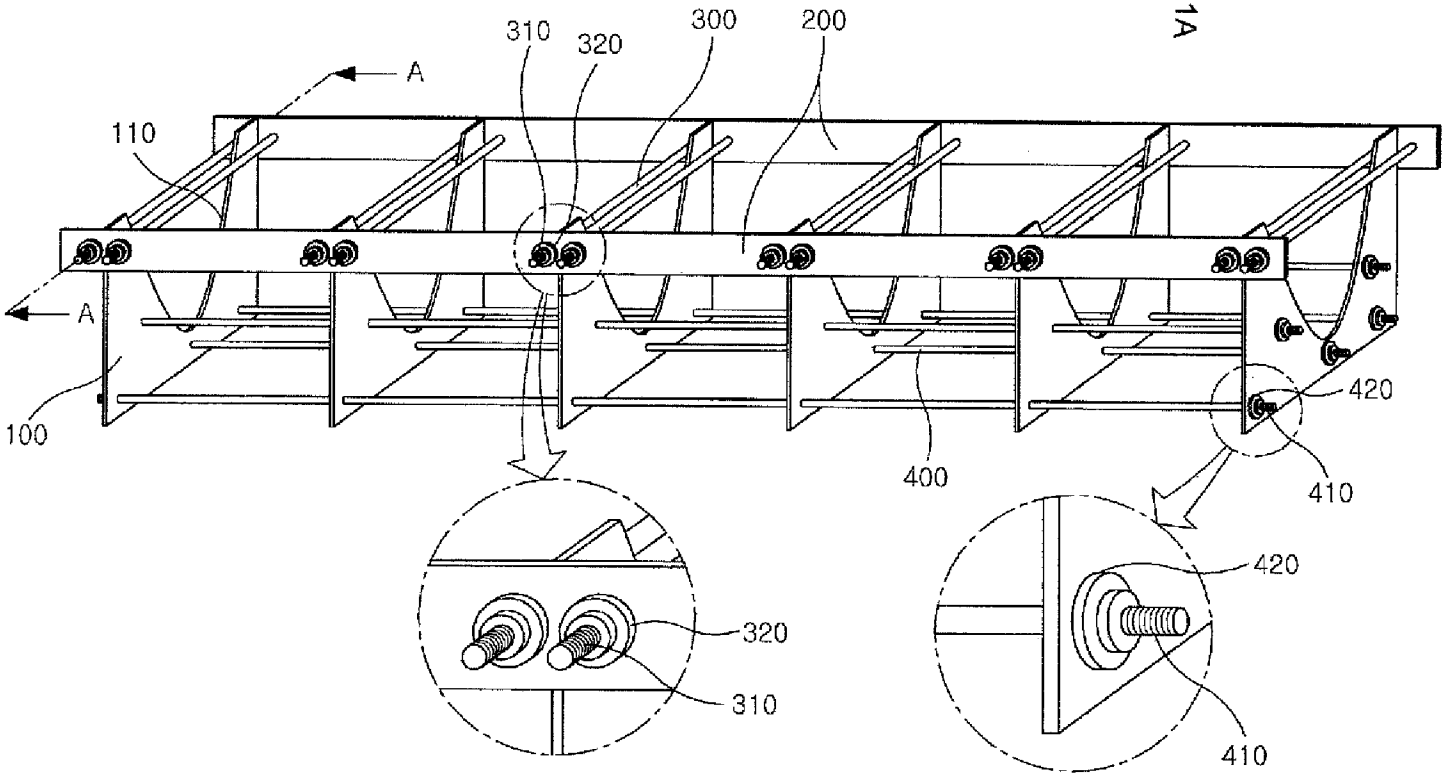
FIG. 1*a* is a perspective view of a reinforcement of foundation according to a first embodiment of the present invention.
FIGS. 1*b* and 1*c* are enlarged perspective views of male threads and nuts in FIG. 1*a*.

Hereinafter, preferred embodiments of the present invention will be described in detail with reference to the accompanying drawings.

FIG. 1*a*is a perspective view of a reinforcement of foundation according to a first embodiment of the present invention, FIG. 1*b* and 1*c* are enlarged perspective views of male threads and nuts in FIG. 1*a*, and FIG. 2 is a plan view of the reinforcement of foundation according to the first embodiment of the present invention.

As shown in FIGS. 1*a* and 2, the reinforcement of foundation according to the present invention comprises a plurality of base steel plates 100 arranged in parallel with one another to be upright with respect the ground; a pair of reinforced steel plates 200 coupled to both ends of the respective base steel plates 100 to fix the positions and orientation of the respective base steel plates 100; a plurality of fastening steel rods 300 placed to extend in a longitudinal direction of the base steel plate 100 and coupled in pair to the reinforced steel plates 200 to be spaced apart rightward and leftward from positions where the base steel plates 100 and the reinforced steel plates 200 are coupled to each other, thereby causing the reinforced steel plates 200 to be kept at a constant interval from each other; and a plurality of connection steel rods 400 penetrated through and coupled to lower ends of the respective base steel plates 100 to fix the positions of the lower ends of the respective base steel plates 100.

The reinforcement of foundation so configured is placed at the bottom of a building after concrete is poured, and then used to support a load of the building. At this time, the number of base steel plates 100 arranged in parallel with each other may be increased or decreased depending on a variety of design conditions such as load of building. If an area of the building to be constructed is large, a plurality of reinforcements of foundation may be used in such a state where they are connected with each other. Further, the respective reinforcements of foundation may be alternately arranged such that load can be uniformly distributed even though the load is applied thereto in any directions.

FIG. 3 is a front view of a reinforced steel plate of the reinforcement of foundation shown in FIGS. 1*a* and 2, and FIG. 4 is a sectional view of a fastening steel bar and its peripherals taken along line A-A of FIG. 1*a*.

As shown in FIG. 3, each of the reinforced steel plates 200 of the present invention extends in a longitudinal direction and is formed with a plurality of first through-holes 210 at positions where the fastening steel rods 300 are coupled thereto, such that the fastening steel rod 300 can pass through the first through-hole 210.

Therefore, the fastening steel rod 300 is coupled to the reinforced steel plates 200 such that both ends thereof can pass through the first through-holes 210 and protrude outward from the reinforced steel plates 200, as shown in FIG. 4. At this time, first male threads 310 are formed on the ends that protrude outward from the reinforced steel plates 200, and the fastening steel rod 300 is fastened to the reinforced steel plates 200 by means of first nuts 320 that can be engaged with the first male threads 310. As the first nuts 320 are tightened, the reinforced steel plates 200 are further brought into close contact with both the ends of the base steel plates 100.

At this time, if the fastening steel rod 300 is coupled to the reinforced steel plate 200 to be spaced apart from the base steel plate 100 by a distance greater than a certain interval, a certain amount of moment is produced at a position on the reinforced steel plate 200, which is in contact with the base steel plate 100, by means of fastening force of the first nut 320. Accordingly, the reinforced steel plate 200 is deformed, and thus, the fastening steel rod 300 is preferably coupled to the reinforced steel plate 200 such that it is placed at a position adjacent to the base steel plate 100 as shown in FIG. 1*a*.

FIG. 5 is a side view of the base steel plate of the reinforcement of foundation shown in FIGS. 1*a* and 2.

As shown in FIG. 5, the base steel plate 100 of the present invention is formed with a cutaway at an upper portion thereof such that load applied thereto from above can be easily transmitted to a side portion thereof. At this time, the cutaway is preferably shaped as a circular arc cutaway 110 such that stress concentration is not produced. The principle and structure of the base steel plate in which the load applied from above is transmitted to the side portion will be hereinafter explained with reference to additional figures.

The base steel plate 100 is further formed with a plurality of second through-holes 120 at positions where the connection steel rods 400 are coupled thereto, such that the connection steel rod 400 can pass through the second through-hole 120. Therefore, the connection steel rod 400 is coupled to the base steel plates 100 such that both ends thereof can pass sequentially through the second through-holes 120 of the base steel plate 100, which is placed to be upright at a predetermined interval and arranged in parallel with each other, and protrude outward from both outermost base steel plates 100, as shown in FIG. 1*a*. At this time, second male threads 410 are formed on the ends of the connection steel rod 400 that protrude outward from the outermost base steel plates 100, and the connection steel rod 400 is fastened to the base steel plates 100 by means of second nuts 420 that can be engaged with the second male threads 410.

Further, the inner base steel plates 100, which the connection steel rod 400 is not fastened to by means of the second nut 420 but simply bored through, are fixedly coupled to the connection steel rod 400 by welding the second through-holes 120 with the connection steel rod 400 brought into contact therewith.

The connection steel rod 400 so coupled not only causes the interval between the base steel plates 100 to be kept constant but also has a function of preventing the base steel plates 100 from coming off from concrete after the concrete has been completely poured.

FIG. 6 is a side view of a base steel plate according to another embodiment of the present invention.

As shown in FIG. 6, a cutaway formed in the base steel plate 100 may be employed in the form of a bent cutaway 110*a* of which sides and bottom are straight.

As compare with a circular arc cutaway 110 shown in FIG. 5, a case where the bent cutaway 110*a* is formed in the base steel plate 100 exhibits similar performance in that the load applied from above is transmitted to the side, but has an advantage in that the cutaway can be very easily manufactured.

FIG. 7 is a side view schematically illustrating a direction of stress produced at respective portions due to a load applied to a reinforcement of foundation according to the present invention.

If vertical load is applied to an upper portion of the reinforcement of foundation of the present invention as shown in FIG. 7, the applied vertical load is primarily supported by the base steel plates 100.

At this time, if the base steel plate 100 of the present invention is shaped as a rectangular flat plate without the circular arc cutaway 110 formed at the upper portion thereof, the base steel plate 100 is likely to be broken when the vertical load is not applied uniformly over an entire top portion of the base steel plate 100 but partially at one side thereof. However, if the circular arc cutaway 110 is formed in the top portion of the base steel plate 100 as shown in FIG. 5, the base steel plate 100 is not broken but both top portions are laterally or longitudinally curved far away from each other even though the vertical load is partially applied. If the two top portions of the base steel plate 100 are spaced apart from each other, a certain tension is applied to the fastening steel rod 300. At this time, since a steel material of which the fastening steel rod is made has such a characteristic that it is weak in compressive force but strong in tensile force, the two top portions of the base steel plate 100 are not deformed.

At this time, since not compressive force but tensile force is applied only to the fastening steel rod 300, it is preferred that the fastening steel rod 300 be made of a densely structured material with high tensile strength rather than a material with high stiffness. This may cause the fastening steel rod 300 to be applied to the present invention in the form of a steel wire other than a steel rod.

The circular arc cutaway 110 of the base steel plate 100 may be substituted with a bent cutaway consisting of at least two straight lines. However, stress may be concentrated on the angular points of the cutaway, whereby the base steel plate is likely to be broken due to crack generation. Therefore, it is preferred that the cutaway be curved smoothly. Further, it is most preferred that the cutaway be shaped as a symmetrical arc as shown in FIG. 5, in order to allow the applied load to be uniformly distributed over the entire base steel plate 100 and also to prevent the base steel plate 100 from being broken.

Although it has been described in this embodiment that the reinforcement of foundation according to the present invention is used only to support the load of building, it is not limited thereto. The reinforcement of foundation according to the present invention may be used to support machinery or other objects with high load.

FIG. 8 is a plan view of a reinforcement of foundation according to a second embodiment of the present invention, and FIG. 9 is a sectional view of the reinforcement of foundation taken along line B-B of FIG. 8.

As shown in FIGS. 8 and 9, the base steel plate 100 of the reinforcement of foundation according to the present invention may be radially arranged to have a constant angular interval around a vertical centerline. In a case where the base steel plate 100 is radially arranged as described above, the load applied from above is radially distributed. Thus, there is an advantage in that the supporting characteristic and stability are improved.

At this time, if all the base steel plates 100 are coupled together at a single point, it is difficult to couple the base steel plates altogether as well as a coupled portion may be damaged due to external force. Therefore, it is preferably configured such that a central pipe 102 with a vertical central axis is provided at a portion where the respective base steel plates 100 join together and that the respective base steel plates 100 are cut along the vertical central axis and their inner ends are then welded to an external surface of the central pipe 102. If the base steel plates 100 are independently coupled to the central pipe 102 as described above, welded portions of the base steel plates 100 are not overlapped with each other. Thus, there is no likelihood that the coupling force is lowered.

In addition, in a case where the base steel plates 100 are radially arranged, the reinforced steel plate 200 is coupled to the base steel plates 100 such that it covers all the both ends of the base steel plates 100 in a circular shape. Further, the fastening steel rods 300 are coupled at different vertical levels such that they do not interfere with each other.

FIG. 10 is a plan view of a reinforcement of foundation according to a third embodiment of the present invention, and FIG. 11 is a sectional view of the reinforcement taken along line C-C of FIG. 10.

As shown in FIGS. 10 and 11, the base steel plate 100 of the reinforcement of foundation according to the present invention comprises at least two transversal base steel plates 100*a* arranged in parallel with each other and at least two longitudinal base steel plates 100*b* arranged in parallel with each other and coupled to the transversal base steel plates 100*a*.

The third embodiment in which the plurality of transversal and longitudinal base steel plates 100*a* and 100*b* are arranged to overlap perpendicularly with each other has improved supporting characteristic and stability as compared with the first embodiment shown in FIG. 1*a*, because the load applied from above is distributed in all directions. Further, this embodiment has an advantage in that the coupling force is not likely to be lowered, because coupled portions of the base steel plates 100*a* and 100*b* are not concentrated on a single point.

In a case where the base steel plates 100*a* and 100*b* are arranged perpendicularly to each other, the reinforced steel plate 200 is coupled to the base steel plates 100 such that it covers all the both ends of the base steel plates 100 in a polygonal shape. Further, the fastening steel rods 300, which are transversally and longitudinally arranged, respectively, are coupled at different vertical levels such that they do not interfere with each other.

Furthermore, the third embodiment shown in FIGS. 10 and 11 does not include the connection steel rods 400 that were provided in the previous embodiments shown in FIGS. 1*a* and 8. However, the connection steel rods may be further provided in this embodiment in order to improve the coupling force.

The reinforcement of foundation according to the present invention may be used in such a state that the cutaway 110 or 110*a* formed in the base steel plate 100 is directed upward or downward.

Even in a case where the cutaway 110 or 110*a* formed in the base steel plate 100 is used to be directed downward, stress is applied to the respective portions due the load applied from above and the resultant reaction in the same manner as shown in FIG. 7. Thus, when in use, a direction in which the reinforcement of foundation according to the present invention is installed may be freely changed depending on the purpose and location of use.

INDUSTRIAL APPLICABILITY

The reinforcement of foundation according to the present invention allows load to be uniformly distributed and has strength strong to compressive and tensile force even though the load is partially applied to the foundation. Therefore, there is an advantage in that the reinforcement of foundation can stably support the objects installed thereon.

Further, the reinforcement of foundation according to the present invention allows the volume of the foundation to be reduced as compared with the prior art, and thus, the excavation can also be made shallow. Therefore, there is another advantage in that the building construction can be easily made at a place where the buildings stand close together and the foundation can be prevented from being brought into contact with the underground water.

Moreover, there is a further advantage in that the reinforcement of foundation according to the present invention allows load applied from above to be distributed in various directions in accordance with the user's selection.

From the foregoing, although the technical scope of the present invention has been described with reference to the preferred embodiments, it should be understood that the embodiments are not for the limitation but for the illustration of the present invention. Further, it will be understood by those skilled in the art that various changes and modifications can be made within the technical spirit and scope of the present invention.

The invention claimed is:

1. A reinforcement of foundation, comprising:

at least two base steel plates shaped as a plate and arranged to be upright with respect to the ground;

a reinforced steel plate coupled to each end of the base steel plates; and fastening steel rods coupled to the reinforced steel plate to be parallel with the base steel plates, wherein each of the base steel plates is formed with a cutaway at the center of a top portion thereof.

2. The reinforcement of foundation as claimed in claim 1, wherein the base steel plates are arranged in parallel with each other.

3. The reinforcement of foundation as claimed in claim 1, wherein the base steel plates are radially arranged to have a constant angular interval around a vertical centerline.

4. The reinforcement of foundation as claimed in claim 1, wherein the base steel plates include at least two transversal base steel plates arranged in a transversal direction and at least one longitudinal base steel plate arranged in a longitudinal direction and coupled to the transversal base steel plates.

5. The reinforcement of foundation as claimed in any one of claims 1 to 4, wherein the reinforced steel plate includes first though-holes formed at positions corresponding to both ends of each of the fastening steel rods, each of the fastening steel rods is coupled to the reinforced steel plate such that the both ends of the fastening steel rod can pass though the first though-holes and protrude outward from the reinforced steel plate, first male threads are formed on the both ends of the fastening steel rod that protrude from the reinforced steel plate, and the fastening steel rod is fastened to the reinforced steel plate by means of first nuts that can be engaged with the first male threads.

6. The reinforcement of foundation as claimed in any one of claims 1 to 4, wherein a pair of the fastening steel rods are placed to extend in a longitudinal direction of the base steel plates and coupled to the reinforced steel plate to be spaced apart rightward and leftward from positions where the base steel plates and reinforced steel plate are coupled to each other.

7. The reinforcement of foundation as claimed in any one of claims 1 to 4, wherein the base steel plate includes at least one second through-hole bored therethough in a direction in which the base steel plates are arranged, and the reinforcement of foundation further comprises a connection steel rod which sequentially passes through the second through-hole of the base steel plates and is coupled to. the base steel plates.

8. The reinforcement of foundation as claimed in claim 7, wherein the connection steel rod protrudes outward from the base steel plates, second male threads are formed on the protruding ends of the connection steel rod, and the connection steel rod is fastened to the base steel plate by means of second nuts that can be engaged with the second male threads.

9. The reinforcement of foundation as claimed in claim 7, wherein the connection steel rod is fixedly welded to the base steel plates at portions thereof where the connection steel rod simply passes through the second though-holes.

* * * * *